US012305857B1

(12) United States Patent
Bolton

(10) Patent No.: US 12,305,857 B1
(45) Date of Patent: May 20, 2025

(54) QUICK CHANGE HOT WATER HEATER THERMOCOUPLE

(71) Applicant: John Darcy Bolton, Irvine, CA (US)

(72) Inventor: John Darcy Bolton, Irvine, CA (US)

( * ) Notice: Subject to any disclaimer, the term of this patent is extended or adjusted under 35 U.S.C. 154(b) by 0 days.

(21) Appl. No.: 18/826,754

(22) Filed: Sep. 6, 2024

Related U.S. Application Data

(60) Provisional application No. 63/731,783, filed on Apr. 17, 2024.

(51) Int. Cl.
*F23N 5/10* (2006.01)
*F24H 1/00* (2022.01)

(52) U.S. Cl.
CPC ..... *F23N 5/107* (2013.01); *F23N 2227/22* (2020.01); *F24H 1/0027* (2013.01)

(58) Field of Classification Search
CPC ..... F23N 5/10; F23N 2227/22; F23N 5/107; F24H 1/0027; F23D 11/36; F23Q 9/00
See application file for complete search history.

(56) References Cited

U.S. PATENT DOCUMENTS 2,355,227 A * 8/1944 Mantz ..... F23N 5/107 136/235
3,930,892 A * 1/1976 Fox ..... F23Q 9/04 374/E1.018
5,302,113 A * 4/1994 Eichelberger ..... F23Q 9/00 431/155
6,648,627 B2 * 11/2003 Dane ..... F23N 5/10 431/76
8,602,643 B2 12/2013 Gerdiner

FOREIGN PATENT DOCUMENTS

EP 2354653 A1 * 8/2011 ..... F23D 14/82
EP 2739914 12/2018
JP H05118536 A * 5/1993
JP 2016084958 A * 5/2016
KR 0170132 B1 * 3/1999

* cited by examiner

*Primary Examiner* — Gregory A Wilson
(74) *Attorney, Agent, or Firm* — Gugliotta & Gugliotta, LPA

(57) ABSTRACT

A quick-change thermocouple system for hot water heaters is disclosed, comprising multiple thermocouples pre-installed on a pull bar within the flame chamber. The system allows for easy replacement of faulty thermocouples without specialized tools or technical knowledge. When a thermocouple fails, the user pulls an external handle, sliding the pull bar to position a new thermocouple over the pilot flame. This action removes the faulty thermocouple and simultaneously installs a fresh one. The system significantly reduces hot water service downtime, eliminates the need for professional intervention, and improves safety by ensuring correct thermocouple replacement. It can be implemented with minimal changes to existing hot water heater designs and allows for multiple replacements without opening the unit. This invention extends the operational lifespan of hot water heaters, reduces costs for homeowners, and promotes self-reliance in home appliance maintenance.

17 Claims, 1 Drawing Sheet

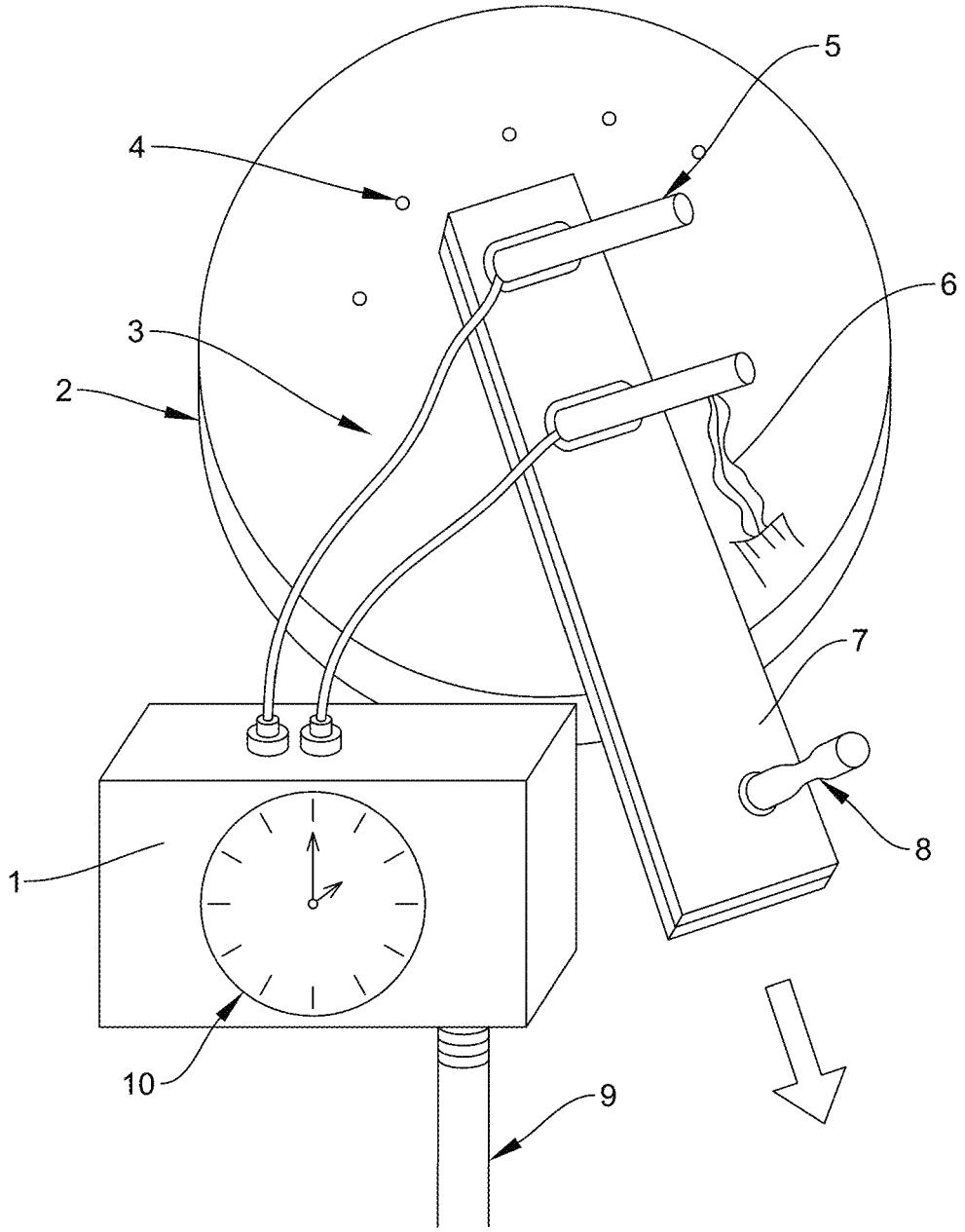
5
4
6
3
2
7
8
1
10
9

QUICK CHANGE HOT WATER HEATER THERMOCOUPLE

CROSS-REFERENCE TO RELATED APPLICATIONS

The present invention claims the benefit of U.S. Provisional Application No. 63/731,783 filed on Apr. 17, 2024 and incorporated by reference as if fully rewritten herein.

BACKGROUND OF THE INVENTION

1. Field of the Invention

The present invention relates generally to hot water heater maintenance and repair and, more particularly, to a system and method for quick and easy replacement of thermocouples in gas-powered hot water heaters.

2. Description of the Related Art

Hot water heaters are essential appliances in most homes, providing heated water for various domestic uses. Many of these heaters, particularly gas-powered models, rely on a crucial component called a thermocouple for safe operation. The thermocouple serves as a safety device, preventing gas flow when the pilot flame is not lit.

In traditional hot water heater designs, the thermocouple is a single unit installed in a fixed position near the pilot flame. When it fails, it no longer generates sufficient electric current to keep the gas valve open. This results in the gas valve closing, extinguishing the pilot flame and preventing the main burner from igniting. The user will notice a lack of hot water, indicating a potential thermocouple failure. This can occurs several times during a hot water heater's lifespan, and requires it to be replaced to restore the heater's functionality. This replacement process often requires specialized knowledge, tools, and access to cramped spaces, making it difficult for most homeowners to perform.

The frequent failure of thermocouples, combined with the complexity of their replacement, leads to several problems, such as: immediate loss of hot water when a thermocouple fails; need for professional intervention, resulting in high costs; extended periods without hot water while waiting for repairs; and, potential safety hazards if replacement is attempted improperly.

Some methods and devices are known to incorporate various mechanisms for improving hot water heater maintenance, but none address the specific issue of quick and easy thermocouple replacement. For example:

European Patent EP 2,739,914B1, issued in the name of Armstrong, discloses a heating element controller for a liquid heating system. While this system provides for remote monitoring of hot water heater performance but does not address the issue of thermocouple replacement.

And, U.S. Pat. No. 8,602,643B2, issued in the name of Gardiner, discloses an improvement in the thermocouple itself, it again does not address the issue of thermocouple replacement.

Consequently, a need has been felt for providing an apparatus and method which allows for quick and easy replacement of thermocouples in hot water heaters, without requiring specialized tools or technical knowledge.

SUMMARY OF THE INVENTION

It is thus an object of the present invention to provide a method of replacing hot water heater thermocouples quickly and easily.

It is a further object of the present invention to provide a system for thermocouple replacement that does not require specialized tools or technical knowledge.

It is still a further object of the present invention to reduce downtime and costs associated with hot water heater thermocouple failures.

The present invention provides a system and method for quick replacement of thermocouples in hot water heaters. In preferred embodiments, the inventive method includes: multiple thermocouples pre-installed within the hot water heater's flame chamber; a simple mechanism for switching between thermocouples without opening the gas lines and risking an explosion and fire; or requiring tools. Multiple pre-installed thermocouples within the hot water heater's flame chamber are a departure from the traditional design that uses only a single thermocouple. A simple mechanism (like a pull bar, rotating bar, or wheel) allows for easy switching between thermocouples without requiring tools or opening the gas line(s). The combination of multiple thermocouples and the switching mechanism creates a system where replacing a faulty thermocouple becomes a simple, quick task that can be performed by anyone, even without technical knowledge. Further, the present configuration allows for in-situ replacement of a thermocouple without removing any parts from the water heater or accessing hard-to-reach areas, which is typically required in traditional designs.

By including multiple thermocouples from the outset, the invention anticipates and solves a common failure point in hot water heaters before it becomes a problem for the user.

It is an advantage of the present invention that it allows for the quick replacement of a faulty thermocouple in a hot water heater without the need for professional assistance.

Another advantage of the present invention is that it eliminates the need for specialized tools in the thermocouple replacement process.

It is an advantage of the present invention that it significantly reduces the downtime of hot water service when a thermocouple fails.

It is another advantage of the present invention that it provides substantial cost savings to homeowners by eliminating the need for professional service calls for thermocouple replacements.

It is an advantage of the present invention that it enables individuals without technical knowledge to easily perform the thermocouple replacement.

Another advantage of the present invention is that it incorporates multiple thermocouples, extending the operational lifespan of the hot water heater before requiring external maintenance.

It is an advantage of the present invention that it improves safety by ensuring that thermocouple replacements are performed correctly, reducing the risk of gas leaks that cause fires and explosions or other hazards.

Another advantage of the present invention is that it empowers homeowners to maintain their own appliances, fostering a sense of self-reliance and potentially increasing their understanding of home systems.

It is an advantage of the present invention that it reduces the physical strain on individuals by eliminating the need to access difficult-to-reach areas of the hot water heater during thermocouple replacement.

It is another advantage of the present invention that it can be implemented with minimal changes to existing hot water heater designs, allowing for easy adoption by manufacturers.

It is an advantage of the present invention that it potentially extends the overall lifespan of hot water heaters by making a common point of failure easily addressable.

Another advantage of the present invention is that it reduces waste by preventing the premature disposal of hot water heaters due to easily fixable thermocouple issues.

Further features of the invention will become apparent in the course of the following description.

BRIEF DESCRIPTION OF DRAWINGS

The advantages and features of the present invention will become better understood with reference to the following more detailed description and claims taken in conjunction with the accompanying drawings, in which like elements are identified with like symbols, and in which:

FIG. 1 depicts a schematic view of the flame chamber and control mechanism of a hot water heater incorporating the Quick Change Hot Water Heater Thermocouple system, according to a preferred embodiment of the present invention.

DETAILED DESCRIPTION OF THE INVENTION

The best mode for carrying out the invention is presented in terms of its preferred embodiment, herein depicted within the FIGURES. It should be understood that the legal scope of the description is defined by the words of the claims set forth at the end of this patent and that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. The embodiments described herein are to be regarded as illustrative rather than restrictive. The invention is not limited to the specific arrangements, constructions, or methodologies described and illustrated. It should be understood that numerous modifications and variations can be made without departing from the spirit and scope of the invention as defined by the claims.

The core concept of this invention is to provide a means for quickly changing a thermocouple in a hot water heater in-situ, without requiring the removal or disassembly of the hot water heater. While specific embodiments have been disclosed, such as the pull bar mechanism, these should be construed as exemplary only. The invention should be interpreted broadly to encompass any and all mechanisms, systems, or methods that allow for the quick replacement or switching of thermocouples within a hot water heater without requiring extensive disassembly or specialized technical knowledge.

This may include, but is not limited to, linear pull mechanisms, rotary systems, sliding arrangements, pivoting structures, electronic switching systems, or any other conceivable method for moving a new thermocouple into position or activating a replacement thermocouple. The invention also encompasses various arrangements and numbers of thermocouples, different user interface designs for activating the change mechanism, and diverse methods for integrating such a system into existing or new hot water heater designs.

The key aspect of the invention is the ability to quickly and easily replace or switch to a functioning thermocouple when one fails, thereby minimizing downtime and eliminating the need for professional intervention in most cases. Any system that achieves this goal should be considered within the scope of this invention, regardless of the specific mechanical, electrical, or other means employed to accomplish it.

Finally, unless a claim element is defined by reciting the word "means" and a function without the recital of any structure, it is not intended that the scope of any claim element be interpreted based on the application of 35 U.S.C. § 112(f).

The best mode for carrying out the invention is presented in terms of its preferred embodiment, herein depicted within the FIGURES.

1. Detailed Description of the Figures

Referring now to the drawings, wherein like reference numerals indicate the same parts throughout the several views, a schematic view is provided of the flame chamber and control mechanism of a hot water heater incorporating the Quick Change Hot Water Heater Thermocouple system according to the preferred embodiment of the present invention. The system comprises: a main control valve (1); a flame chamber pan (2); a thermocouple wire (3); a gas outlet (4); multiple thermocouples (5); a pilot flame (6); a thermocouple pull bar (7); a pull bar handle (8); a main gas supply line (9); and a gas control dial (10).

The main control valve (1) is the central control unit of the hot water heater. It regulates gas flow to the pilot flame and main burner. The main control valve receives electrical signals from the active thermocouple, which keeps the gas valve open when the pilot flame is lit. It interacts directly with the thermocouple wire (3) and the gas control dial (10).

The flame chamber pan (2) is preferably a circular structure that houses the pilot flame, main burner, and the quick-change thermocouple mechanism. It provides a controlled environment for combustion and heat transfer. The flame chamber pan interacts with all other components within it, particularly the thermocouples (5) and the thermocouple pull bar (7).

The thermocouple wire (3) conducts the small electrical current generated by the active thermocouple to the main control valve (1). It is a critical link in the safety mechanism, ensuring that gas only flows when the pilot flame is lit. The thermocouple wire interacts with the active thermocouple (5) and the main control valve (1).

The gas outlet (4) delivers gas to the main burner. It is controlled by the main control valve (1) and only opens when the thermocouple indicates that the pilot flame is lit, and the thermostat calls for heat.

Multiple thermocouples (5) are the core components of the quick-change system. Multiple thermocouples are attached to the thermocouple pull bar (7). Only one thermocouple is active at a time, positioned over the pilot flame (6). When heated, it generates a small electric current that keeps the gas valve open. The other thermocouples are held in reserve, ready to be moved into position when needed.

The pilot flame (6) is a small, constantly burning flame that ignites the main burner when needed. It also heats the active thermocouple, enabling it to generate the necessary electric current. The pilot flame interacts directly with the active thermocouple (5) and indirectly with the main control valve (1) through the thermocouple's electrical signal.

A thermocouple pull bar (7) holds multiple thermocouples (5) and allows them to be moved into and out of position over the pilot flame (6). It slides within the flame chamber pan (2) when the pull bar handle (8) is operated. The pull bar interacts with the thermocouples (5), the flame chamber pan (2), and the pull bar handle (8).

Also, a pull bar handle (8) provides a user interface for the quick-change system. Located outside the hot water heater for easy access, it allows the user to move the thermocouple pull bar (7) without opening the heater or using tools. It directly interacts with the thermocouple pull bar (7) and indirectly with the thermocouples (5).

The main gas supply line (9) brings gas from the external supply into the hot water heater. It connects to the main control valve (1), which regulates the gas flow to the pilot flame and main burner.

A gas control dial (10) on the main control valve (1) allows the user to control the overall operation of the hot water heater. It typically has "Off," "Pilot," and "On" settings. The gas control dial interacts directly with the main control valve (1) and indirectly with all other components by controlling outgoing water temperature by modulating gas flow.

The interaction of these components creates a system where:

- The active thermocouple (5) is heated by the pilot flame (6), generating an electric current;
- This current travels through the thermocouple wire (3) to the main control valve (1), keeping the gas valve open.
- If the thermocouple fails, the current stops, and the main control valve (1) shuts off the gas supply for safety.
- The user can then use the pull bar handle (8) to move the thermocouple pull bar (7), replacing the failed thermocouple with a fresh one without opening the heater.
- Once a new thermocouple is in place, the user can reset the system using the gas control dial (10), restoring hot water service quickly and safely.

This system of interactions allows for quick, safe, and easy replacement of failed thermocouples, significantly reducing downtime and eliminating the need for professional intervention in most cases.

In addition to the preferred embodiment described above, an alternative embodiment of the Quick Change Hot Water Heater Thermocouple system is proposed. This alternative design offers a different approach to addressing the same problem of facilitating easy thermocouple replacement in hot water heaters.

In this alternative embodiment, the system comprises a single thermocouple attached to the push bar via a snap mechanism, a fully removable push bar that can be completely withdrawn from the hot water heater, and a connection point where the thermocouple attaches to the main control valve.

When the thermocouple fails, the user follows a series of steps to replace it. First, they pull the push bar completely out of the hot water heater. Then, they unsnap the failed thermocouple from the push bar and disconnect it from the main control valve. Next, they obtain a new thermocouple of the correct length and snap it onto the push bar. Finally, they push the bar back into the hot water heater, positioning the new thermocouple over the pilot flame, and connect the new thermocouple to the main control valve.

This alternative embodiment offers several advantages. It features a simpler mechanical design with fewer moving parts, which could potentially lower manufacturing costs. It also allows for visual inspection of the thermocouple before reinstallation and provides flexibility to replace with thermocouples from various manufacturers, as long as they are the correct length and compatible with the snap mechanism.

However, this design also has some disadvantages compared to the primary embodiment. It requires more active participation from the user and necessitates that the user obtain a replacement thermocouple, which may not be immediately available. The replacement process is slightly more complex and may be challenging for some users. There is also potential for user error in connecting the new thermocouple to the main control valve.

While this alternative embodiment still achieves the goal of simplifying thermocouple replacement, it differs from the primary embodiment in several key aspects. It requires more steps and greater user involvement in the replacement process. Although the mechanical design is simpler, the replacement procedure is more complex for the user. It does, however, allow for easier replacement with thermocouples from different manufacturers and potentially offers lower manufacturing costs due to its simpler design.

This alternative embodiment presents a trade-off between mechanical simplicity and ease of use. It may be preferred in situations where manufacturing cost is a primary concern, or where the ability to use thermocouples from various manufacturers is valued. However, it may be less suitable for users who prefer a more automated or simpler replacement process. The choice between the primary and alternative embodiments would depend on the specific needs and preferences of the manufacturer and end-users.

2. Operation of the Preferred Embodiment

In operation the Quick Change Hot Water Heater Thermocouple system can be described in several phases: normal operation, thermocouple failure detection, thermocouple replacement, and system reset.

Normal Operation. During normal operation, one of the thermocouples (5) is positioned directly over the pilot flame (6). This thermocouple generates a small electric current when heated by the pilot flame, which keeps the gas valve open, allowing gas to flow to the pilot flame and main burner when needed.

The other thermocouples are positioned away from the pilot flame on the thermocouple pull bar (7), ready for use when needed.

Thermocouple Failure Detection. When the active thermocouple fails, it no longer generates sufficient electric current to keep the gas valve open. This results in the gas valve closing, extinguishing the pilot flame and preventing the main burner from igniting. The user will notice a lack of hot water, indicating a potential thermocouple failure.

Thermocouple Replacement. To replace the failed thermocouple, the user follows these steps:

a. Locate the pull bar handle (8) on the exterior of the hot water heater.
b. Grasp the handle (8) firmly.
C. Pull the handle (8) towards themselves in a smooth, steady motion.
d. Continue pulling until they feel a slight resistance, indicating that the next thermocouple is in position over the pilot flame. This action slides the thermocouple pull bar (7) within the flame chamber pan (2). As the bar moves, it withdraws the failed thermocouple from its position over the pilot flame and simultaneously moves a fresh thermocouple into position.

System Reset. After the thermocouple has been replaced via the pull bar mechanism, the user must reset the system:

a. Turn the gas control dial (10) to the "Off" position.
b. Wait for approximately 3 minutes to allow any residual gas to dissipate. c. Turn the gas control dial (10) to the "Pilot" position.
d. Press and hold down the gas control dial (10) while simultaneously pressing the igniter button (if equipped) or using a long lighter to ignite the pilot flame.
e. Continue holding down the gas control dial (10) for about 1 minute after the pilot flame ignites.

f. Release the gas control dial (10) and ensure the pilot flame remains lit.

g. Turn the gas control dial (10) to the "On" position. If these steps are successful, the hot water heater should resume normal operation with the new thermocouple in place.

Repeat Replacement. The process can be repeated when subsequent thermocouples fail, allowing for multiple replacements without requiring any tools or technical expertise. The number of replacements possible is determined by the number of thermocouples initially installed on the pull bar.

In operation, the Quick Change Hot Water Heater Thermocouple system allows for easy replacement of a faulty thermocouple. When a thermocouple fails, the user simply pulls the handle (8) of the thermocouple pull bar (7). This action removes the faulty thermocouple from the pilot flame (6) and positions a fresh thermocouple over the flame. This simple operation can be performed without tools, without opening the hot water heater, and without any specialized knowledge. It restores hot water service quickly and easily, eliminating the need for professional intervention in most cases.

The foregoing descriptions of specific embodiments of the present invention are presented for purposes of illustration and description. The Title, Background, Summary, Brief Description of the Drawings and Abstract of the disclosure are hereby incorporated into the disclosure and are provided as illustrative examples of the disclosure, not as restrictive descriptions. It is submitted with the understanding that they will not be used to limit the scope or meaning of the claims. In addition, in the Detailed Description, it can be seen that the description provides illustrative examples, and the various features are grouped together in various embodiments for the purpose of streamlining the disclosure. This method of disclosure is not to be interpreted as reflecting an intention that the claimed subject matter requires more features than are expressly recited in each claim. Rather, as the following claims reflect, inventive subject matter lies in less than all features of a single disclosed configuration or operation. The following claims are hereby incorporated into the Detailed Description, with each claim standing on its own as a separately claimed subject matter.

The claims are not intended to be limited to the aspects described herein but are to be accorded the full scope consistent with the language claims and to encompass all legal equivalents. Notwithstanding, none of the claims are intended to embrace subject matter that fails to satisfy the requirement of 35 U.S.C. § 101, 102, or 103, nor should they be interpreted in such a way. Any unintended embracement of such subject matter is hereby disclaimed. They are not intended to be exhaustive nor to limit the invention to precise forms disclosed and, obviously, many modifications and variations are possible in light of the above teaching. The embodiments are chosen and described in order to best explain principles of the invention and its practical application, to thereby enable others skilled in the art to best utilize the invention and its various embodiments with various modifications as are suited to the particular use contemplated. It is intended that a scope of the invention be defined broadly by the Drawings and Specification appended hereto and to their equivalents. Therefore, the scope of the invention is in no way to be limited only by any adverse inference under the rulings of Warner-Jenkinson Company, v. Hilton Davis Chemical, 520 US 17 (1997) or Festo Corp. v. Shoketsu Kinzoku Kogyo Kabushiki Co., 535 U.S. 722 (2002), or other similar caselaw or subsequent precedent should not be made if any future claims are added or amended subsequent to this Patent Application.

The invention claimed is:

1. A quick-change thermocouple system for a hot water heater, comprising:

a flame chamber pan;

a plurality of thermocouples;

a thermocouple pull bar mounted within the flame chamber pan, wherein the plurality of thermocouples are attached to the thermocouple pull bar;

a pull bar handle connected to the thermocouple pull bar and accessible from outside the hot water heater; and wherein movement of the pull bar handle causes the thermocouple pull bar to move within the flame chamber pan, thereby changing the position of the thermocouples relative to a pilot flame.

2. The system of claim 1, wherein the plurality of thermocouples comprises at least two thermocouples.

3. The system of claim 1, further comprising a main control valve connected to the thermocouples via a thermocouple wire.

4. The system of claim 1, wherein the movement of the pull bar handle is a linear pulling motion.

5. A method for replacing a thermocouple in a hot water heater, comprising:

providing a hot water heater with a quick-change thermocouple system according to claim 1;

detecting a failure of an active thermocouple;

grasping the pull bar handle;

pulling the pull bar handle in a smooth, steady motion until resistance is felt, indicating that a new thermocouple is positioned over the pilot flame.

6. The method of claim 5, further comprising resetting the hot water heater system after replacing the thermocouple.

7. The method of claim 6, wherein resetting the hot water heater system comprises:

turning a gas control dial to an "Off" position;

waiting for a predetermined period of time;

turning the gas control dial to a "Pilot" position;

pressing and holding down the gas control dial while igniting the pilot flame;

continuing to hold down the gas control dial for a set period of time after the pilot flame ignites;

releasing the gas control dial and ensuring the pilot flame remains lit; and turning the gas control dial to an "On" position.

8. A hot water heater comprising:

a main control valve;

a flame chamber pan;

a pilot flame;

a gas control dial;

a quick-change thermocouple system according to claim 1.

9. The hot water heater of claim 8, wherein the quick-change thermocouple system allows for replacement of a faulty thermocouple without the need for specialized tools or technical knowledge.

10. The hot water heater of claim 8, wherein the quick-change thermocouple system allows for multiple thermocouple replacements without opening the hot water heater.

11. In a hot water heater wherein the improvement comprises:

incorporation of more than one thermocouple mounted inside a flame chamber of the hot water heater; and a means to move between thermocouples comprising a pull bar mechanism such that upon failure of one of said thermocouple, another may be shifted into a position over a pilot flame, wherein the pull bar mechanism includes:

a thermocouple pull bar mounted within the flame chamber; and a pull bar handle connected to the thermocouple pull bar and accessible from outside the hot water heater.

12. The hot water heater of claim 11, wherein the one or more thermocouples are attached to the thermocouple pull bar.

13. The hot water heater of claim 12, wherein the more than one thermocouples are attached to the thermocouple pull bar; and the means to move between thermocouples operates without requiring the opening of the hot water heater.

14. The hot water heater of claim 12, wherein the means to move between thermocouples further comprises a rotating mechanism.

15. The hot water heater of claim 11, wherein the means to move between thermocouples operates without requiring the opening of the hot water heater.

16. The hot water heater of claim 11, wherein the means to move between thermocouples is operable without specialized tools.

17. The hot water heater of claim 11, wherein the means to move between thermocouples comprises a rotating mechanism.

* * * * *